US011476580B2

(12) United States Patent
Soma et al.

(10) Patent No.: US 11,476,580 B2
(45) Date of Patent: Oct. 18, 2022

(54) ANTENNA AND COMMUNICATION DEVICE

(71) Applicant: JAPAN AVIATION ELECTRONICS INDUSTRY, LIMITED, Tokyo (JP)

(72) Inventors: Tatsuya Soma, Tokyo (JP); Keishi Kosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/271,435

(22) PCT Filed: Sep. 10, 2019

(86) PCT No.: PCT/JP2019/035430
§ 371 (c)(1),
(2) Date: Feb. 25, 2021

(87) PCT Pub. No.: WO2020/054681
PCT Pub. Date: Mar. 19, 2020

(65) Prior Publication Data

US 2021/0194132 A1 Jun. 24, 2021

(30) Foreign Application Priority Data

Sep. 12, 2018 (JP) ..... JP2018-170131

(51) Int. Cl.
*H01Q 7/00* (2006.01)
*H01Q 5/35* (2015.01)

(52) U.S. Cl.
CPC ..... *H01Q 7/00* (2013.01)

(58) Field of Classification Search
CPC ..... H01Q 7/00; H01Q 7/008; H01Q 5/35; H01Q 5/371; H01Q 9/045; H01Q 13/10
See application file for complete search history.

(56) References Cited

U.S. PATENT DOCUMENTS 9,496,616 B2 * 11/2016 Toyao ..... H01P 5/107
10,374,285 B2 * 8/2019 Miura ..... H01Q 1/48
(Continued)

FOREIGN PATENT DOCUMENTS

CN 106329145 A 1/2017
JP 2016063449 A 4/2016
(Continued)

OTHER PUBLICATIONS

International Search Report (ISR) (and English translation thereof) dated Nov. 19, 2019 issued in International Application No. PCT/JP2019/035430.
(Continued)

*Primary Examiner* — Thai Pham
(74) *Attorney, Agent, or Firm* — Holtz, Holtz & Volek PC

(57) ABSTRACT

An antenna includes a split-ring conductive portion and a ring-inside conductive portion. The split-ring conductive portion is positioned outside a region and is positioned in an area which extends along an outline of the region except for a split. The ring-inside conductive portion is positioned inside the region. The ring-inside conductive portion is continuous with one of parts of the split-ring conductive portion, the split being put between the parts of the split-ring conductive portion. At least a part of the ring-inside conductive portion is bent so as to extend parallel to the split-ring conductive portion.

7 Claims, 17 Drawing Sheets

(56) References Cited

U.S. PATENT DOCUMENTS

| | | | | |
|---|---|---|---|---|
| 2003/0117325 | A1* | 6/2003 | Jo | H01Q 5/371 343/702 |
| 2014/0203993 | A1* | 7/2014 | Toyao | H01Q 13/10 343/867 |
| 2015/0116179 | A1* | 4/2015 | Mikata | H01Q 1/38 343/845 |
| 2015/0116187 | A1 | 4/2015 | Smith et al. | |
| 2016/0174197 | A1 | 6/2016 | Oon et al. | |
| 2017/0040689 | A1 | 2/2017 | Toyao | |
| 2017/0294952 | A1 | 10/2017 | Uchida | |
| 2018/0123261 | A1* | 5/2018 | Sano | H01Q 9/0442 |

FOREIGN PATENT DOCUMENTS

| | | | |
|---|---|---|---|
| JP | 2018074506 | A | 5/2018 |
| WO | 2013027824 | A1 | 2/2013 |

OTHER PUBLICATIONS

Written Opinion dated Nov. 19, 2019 issued in International Application No. PCT/JP2019/035430.

Extended European Search Report (EESR) dated Jul. 28, 2021 issued in counterpart European Application No. 19859575.3.

European Office Action dated Feb. 23, 2022, issued in counterpart European Application No. 19859575.3.

* cited by examiner

ANTENNA AND COMMUNICATION DEVICE

TECHNICAL FIELD

This invention relates to an antenna and a communication device.

BACKGROUND ART

An antenna using a split-ring resonator is known as a small antenna used for a wireless communication device. For example, a wireless communication device comprising a split-ring resonator is disclosed in Patent Document 1.

PRIOR ART DOCUMENTS

Patent Document(s)

Patent Document 1: WO2013/027824

SUMMARY OF INVENTION

Technical Problem

In the antenna of Patent Document 1, the number of a resonant frequency of the split-ring resonator is one. Thus, the antenna of Document 1 has a problem "how the antenna resonates at a plurality of resonant frequencies or has a broadband frequency response, while the antenna has advantages (small size and low manufacturing cost) of its split-ring resonator".

Solution to Problem

For example, an antenna according to an aspect of the present disclosure may comprise a split-ring conductive portion and a ring-inside conductive portion, wherein: the split-ring conductive portion may be positioned outside a region and may be positioned in an area which extends along an outline of the region except for a split; the ring-inside conductive portion may be positioned inside the region; the ring-inside conductive portion may be continuous with one of parts of the split-ring conductive portion, the split being put between the parts of the split-ring conductive portion; and at least a part of the ring-inside conductive portion may be bent so as to extend parallel to the split-ring conductive portion.

A communication device according to an aspect of the present disclosure may comprise the antenna according to an aspect of the present disclosure.

Advantageous Effects of Invention

For example, various aspects of the present disclosure can provide an antenna, which, while having advantages (small size and low manufacturing cost) of its split-ring resonator, resonates at a plurality of resonant frequencies or has a broadband frequency response, and can provide a communication device comprising the antenna.

DESCRIPTION OF EMBODIMENTS

Figure 1:
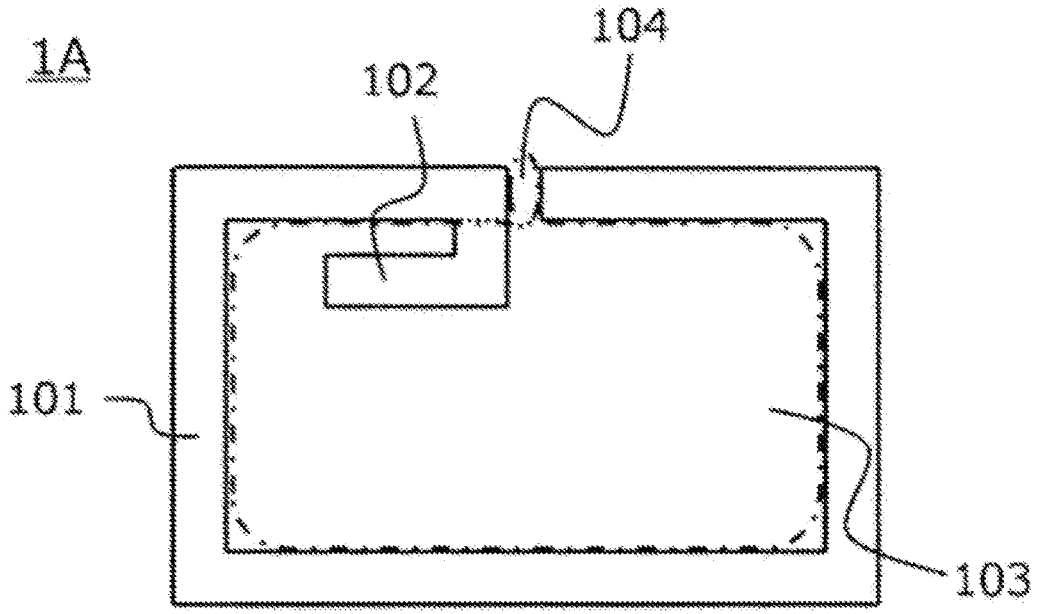
FIG. 1 is a view of an example of an antenna according to an aspect of the present disclosure.
Figure 2:
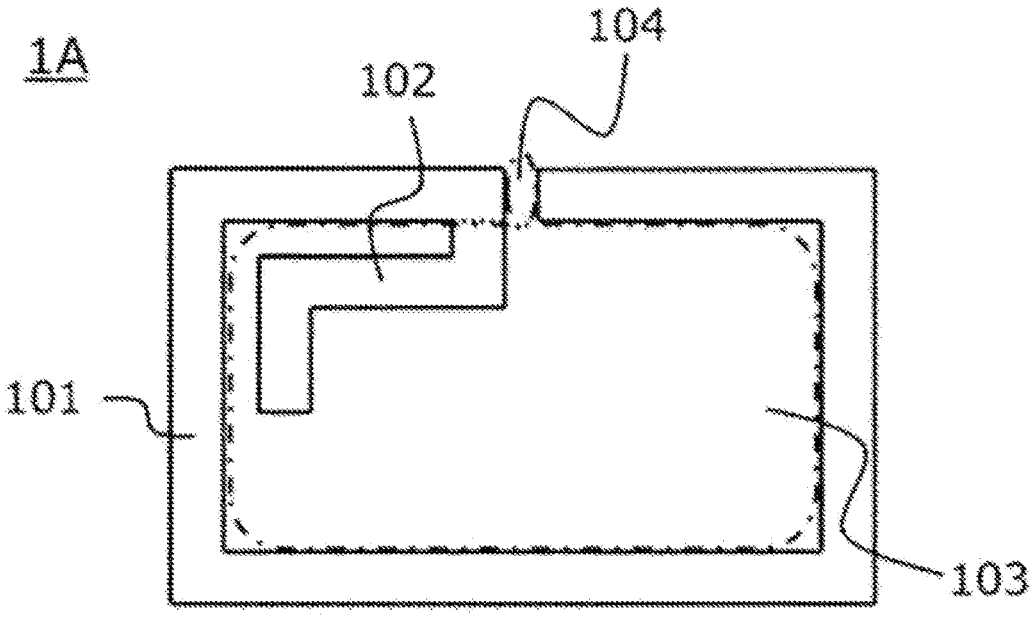
FIG. 2 is a view of an example of an antenna according to an aspect of the present disclosure.
Figure 3:
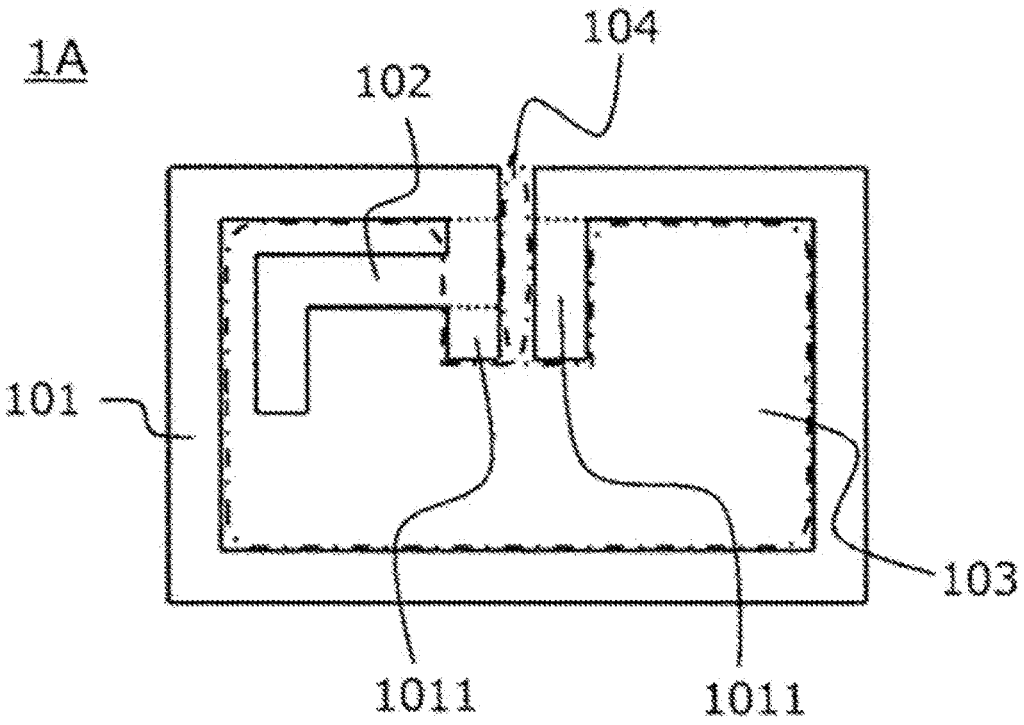
FIG. 3 is a view of an example of an antenna according to an aspect of the present disclosure.
Figure 4:
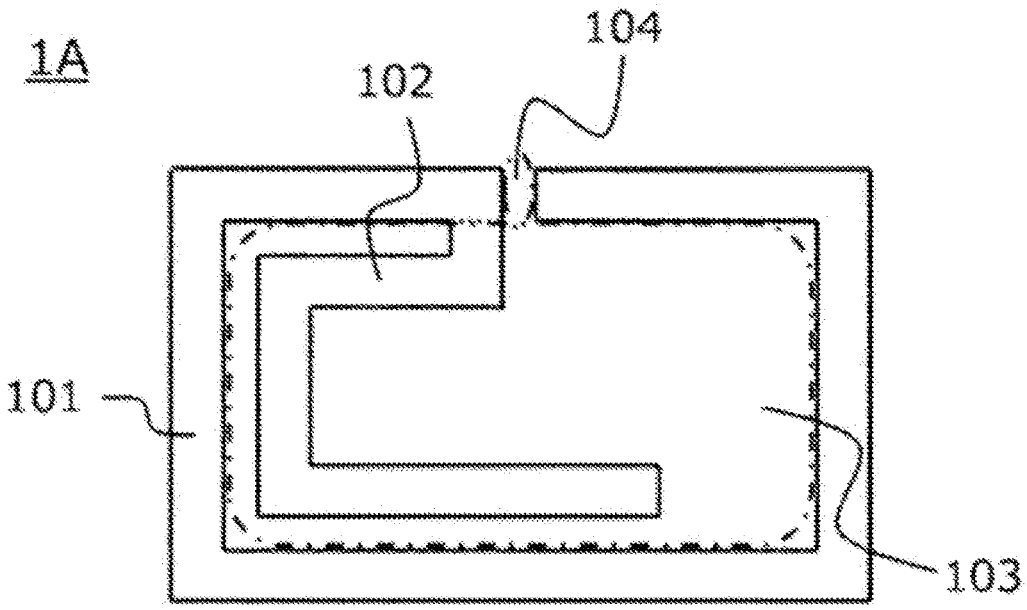
FIG. 4 is a view of an example of an antenna according to an aspect of the present disclosure.
Figure 5:
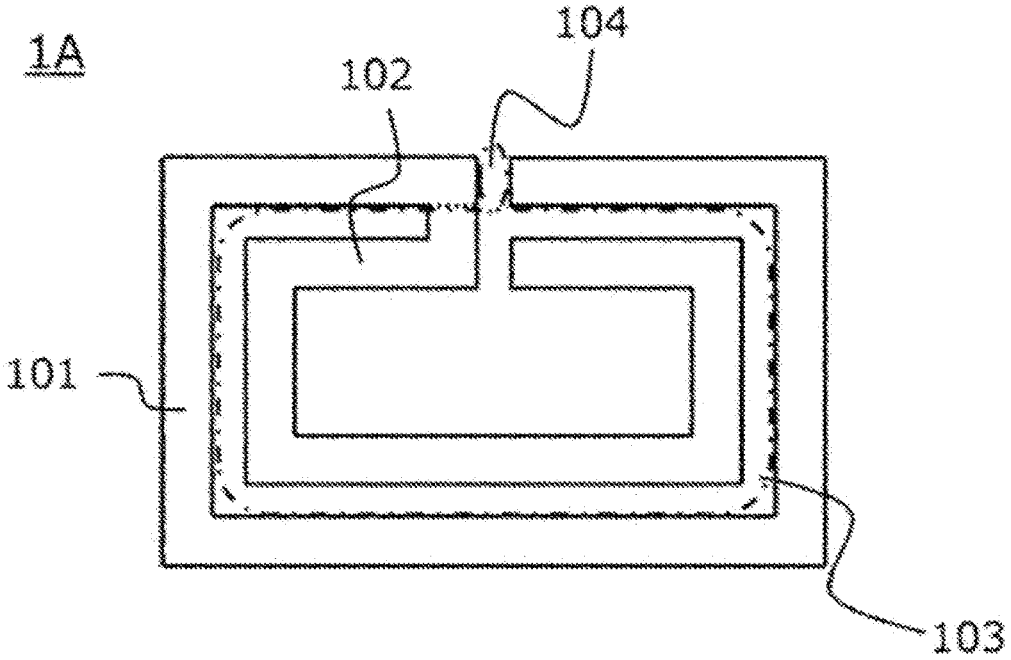
FIG. 5 is a view of an example of an antenna according to an aspect of the present disclosure.
Figure 6:
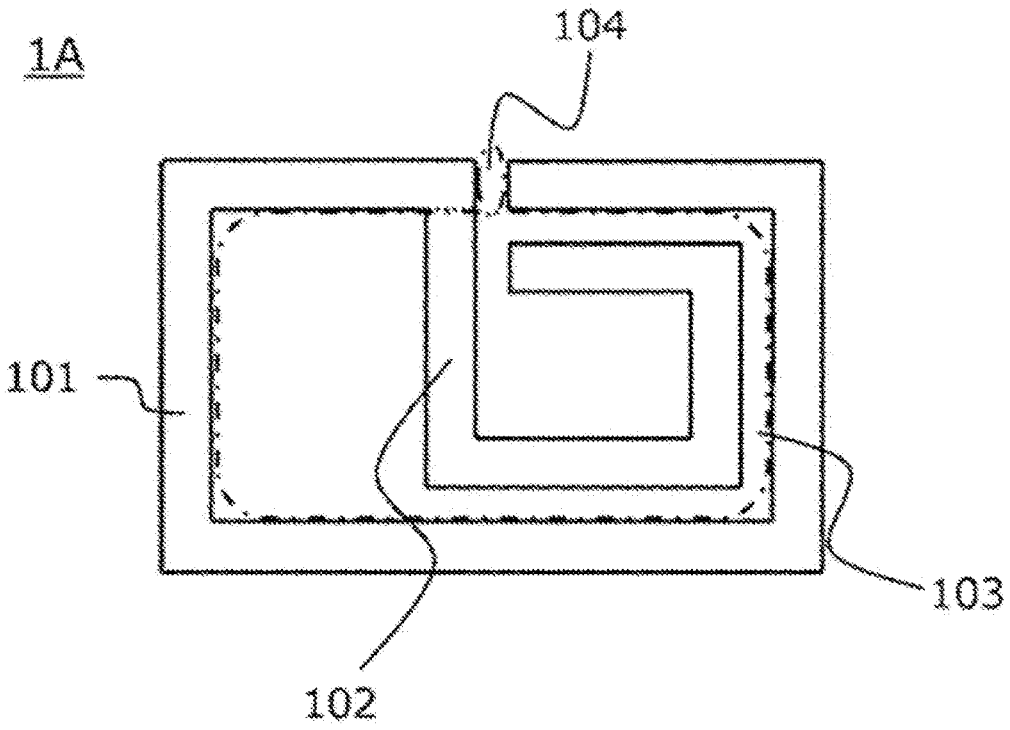
FIG. 6 is a view of an example of an antenna according to an aspect of the present disclosure.
Figure 7:
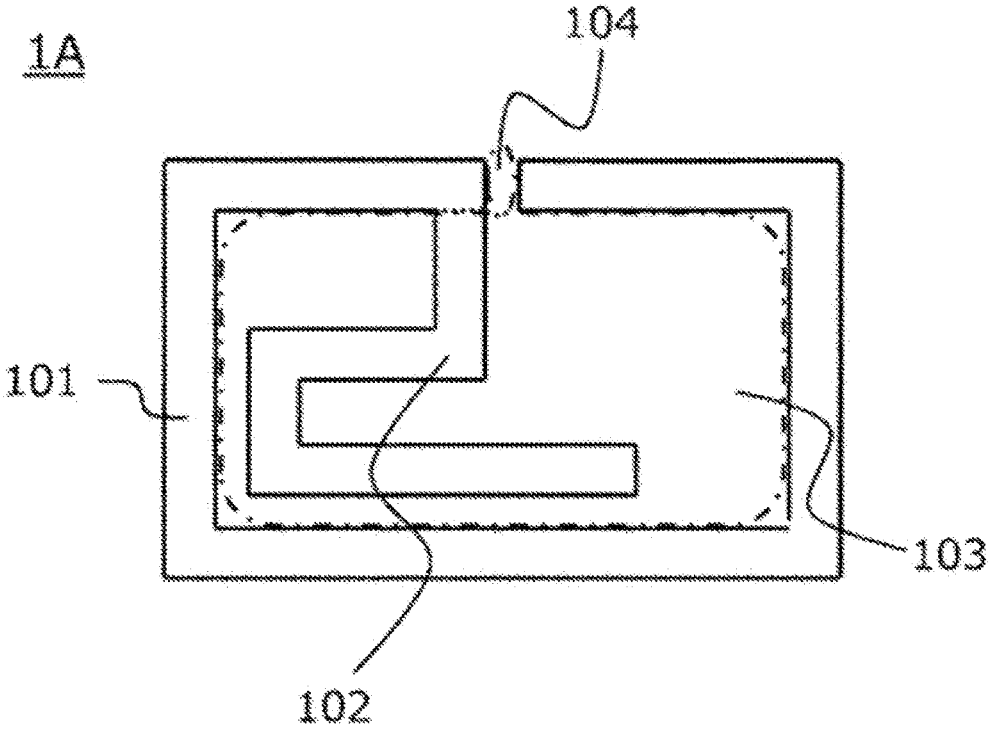
FIG. 7 is a view of an example of an antenna according to an aspect of the present disclosure.
Figure 8:
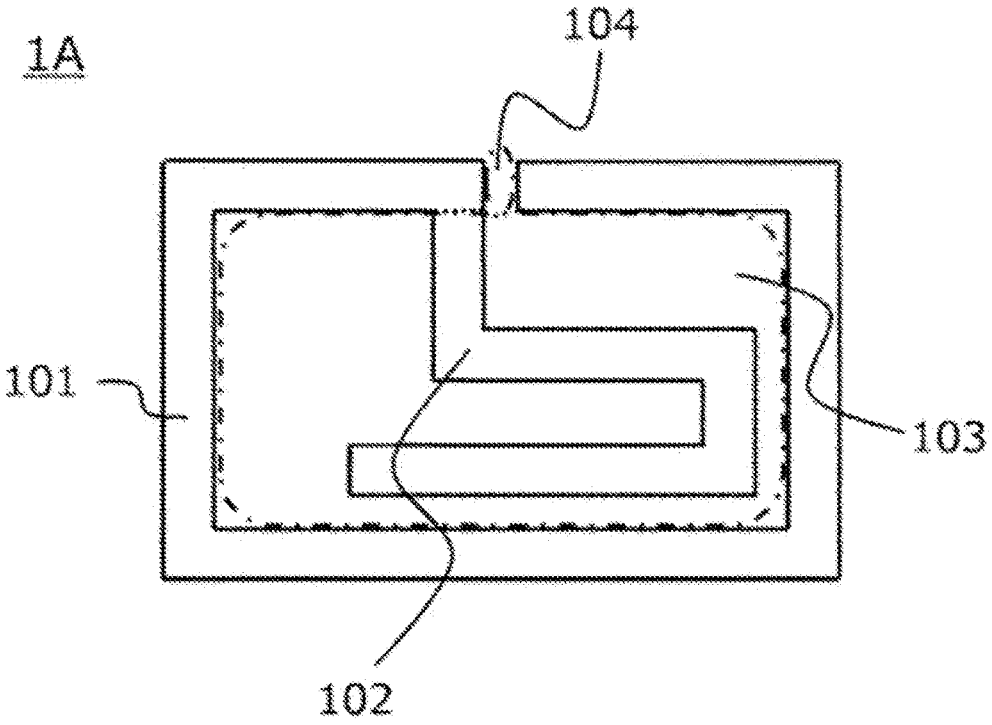
FIG. 8 is a view of an example of an antenna according to an aspect of the present disclosure.
Figure 9:
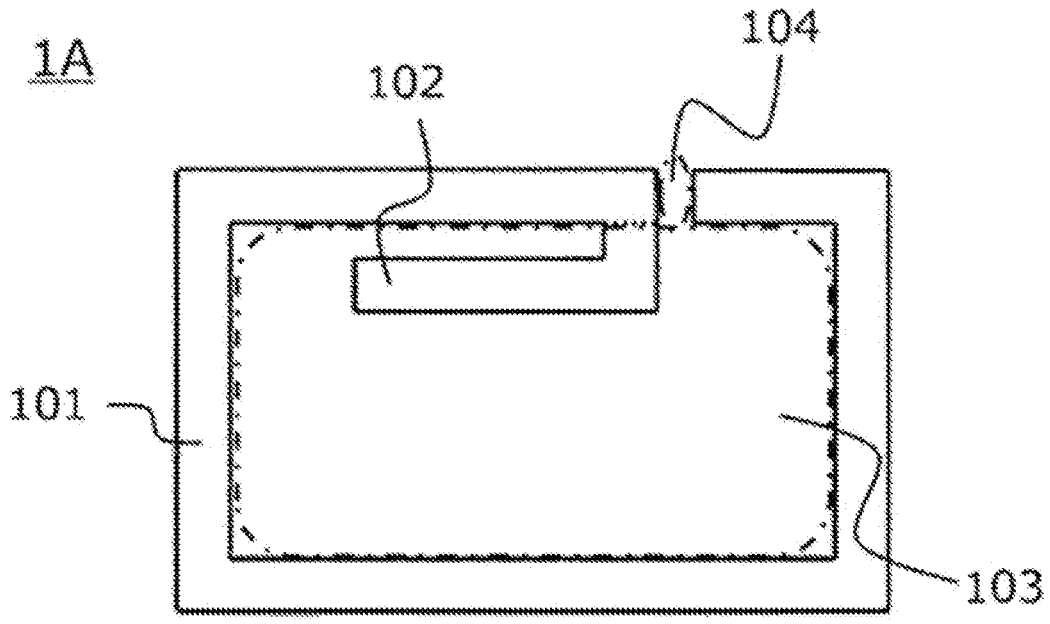
FIG. 9 is a view of an example of an antenna according to an aspect of the present disclosure.
Figure 10:
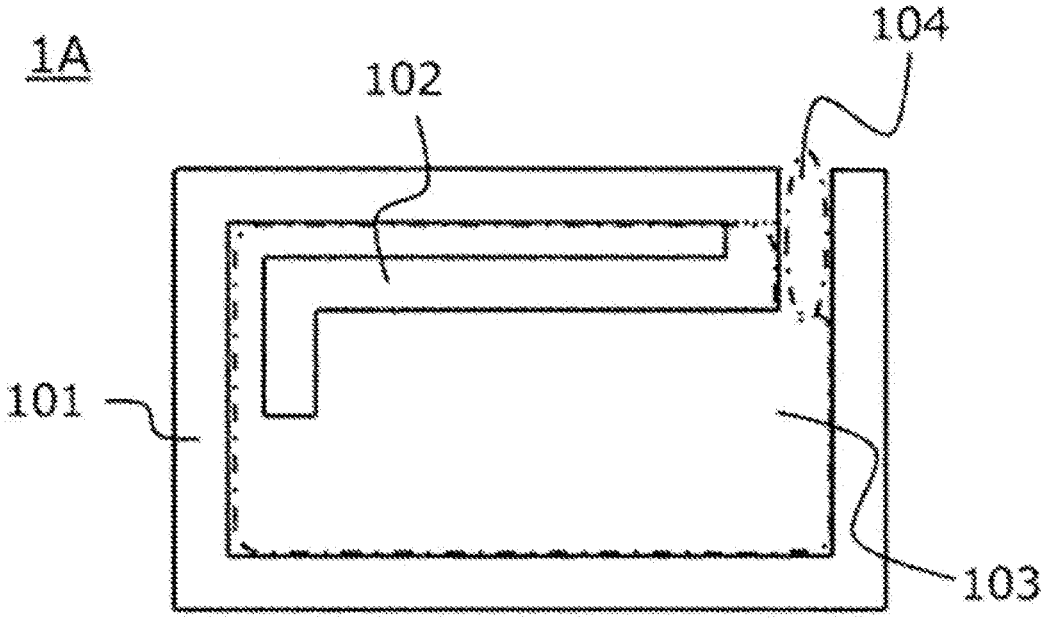
FIG. 10 is a view of an example of an antenna according to an aspect of the present disclosure.
Figure 11:
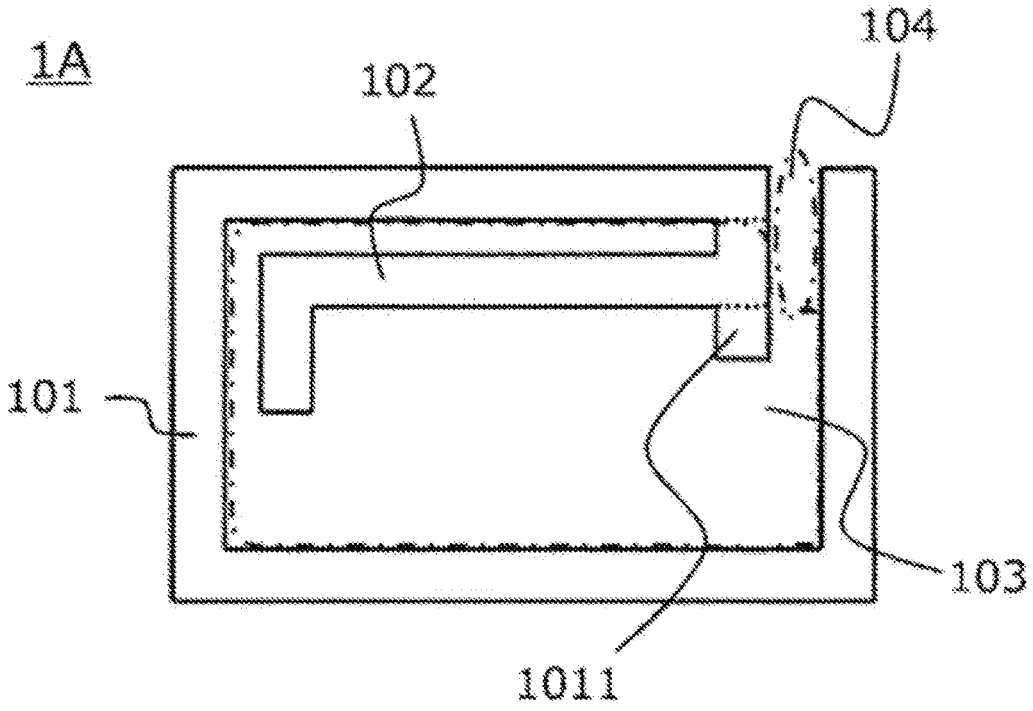
FIG. 11 is a view of an example of an antenna according to an aspect of the present disclosure.
Figure 12:
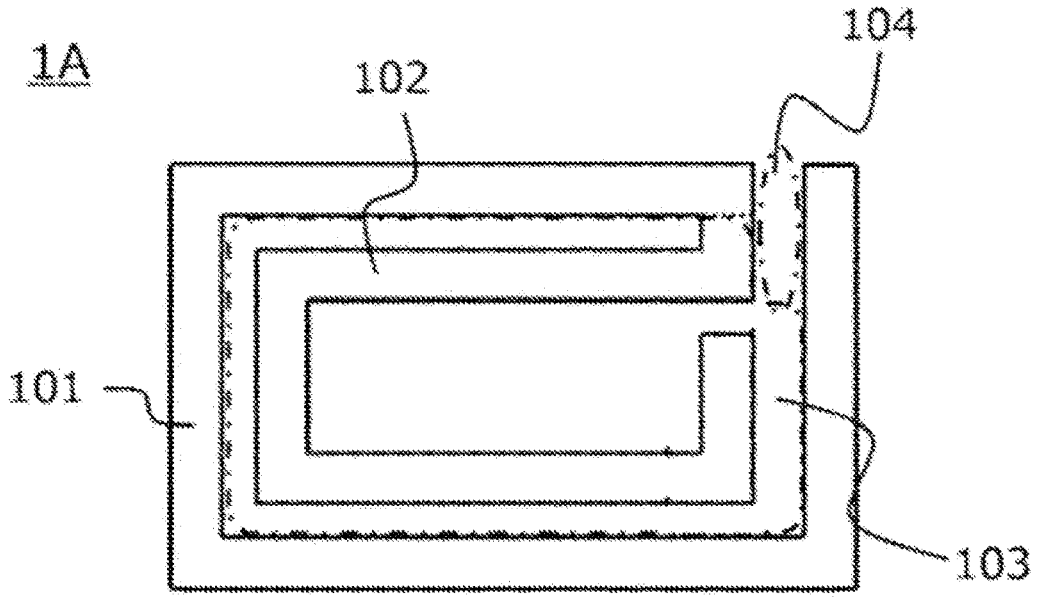
FIG. 12 is a view of an example of an antenna according to an aspect of the present disclosure.

All aspects according to the present disclosure are merely examples, and they are neither intended to exclude other examples from the present disclosure nor intended to limit technical features of the invention described in Claims.

The description about combinations of the aspects according to the present disclosure may be partially omitted. Such omissions are intended to simplify the description, and they are neither intended to be excluded from the present disclosure nor intended to limit the technical scope of the invention described in Claims. All combinations of the aspects according to the present disclosure are included in the present disclosure either explicitly, implicitly or inherently with or without such omissions. Thus, all combinations of the aspects according to the present disclosure can be directly and clearly conceived from the present disclosure with or without such omission.

As shown in FIGS. 1 to 12, for example, an antenna according to an aspect of the present disclosure may comprise a split-ring conductive portion 101 and an ring-inside conductive portion 102, wherein: the split-ring conductive portion 101 may be positioned outside a region 103 and may be positioned in an area which extends along an outline of the region 103 except for a split 104; the ring-inside conductive portion 102 may be positioned inside the region 103; the ring-inside conductive portion 102 may be continuous with one of parts of the split-ring conductive portion 101, the split 104 being put between the parts of the split-ring conductive portion 101; and at least a part of the ring-inside conductive portion 102 may be bent so as to extend parallel to the split-ring conductive portion 101.

For example, the region 103 may be surrounded by the split-ring conductive portion 101 and the split 104. For example, the region 103 may have any shape; it may have a shape of a polygon including a square, a rectangle, etc., a circle, an oval, etc.

For example, the split-ring conductive portion 101 may be formed of a metal plate. For example, the split-ring conductive portion 101 may have any shape; it may have a shape based on an approximately C-shape along a rectangular-ring, or a shape based on a shape extending along one of various rings, such as a circular ring, an oval ring, a track-shaped ring, etc. For example, the parts of the split-ring conductive portion 101, which are positioned so that the split 104 is put therebetween, may comprise an auxiliary conductive portion 1011. The auxiliary conductive portion 1011 may be provided at the same layer where the split-ring conductive portion 101 is provided, or may be provided at a different layer from the layer where the split-ring conductive portion 101 is provided.

For example, the split 104 may be filled with nothing, or may be filled with resin or the like. For example, the split 104 may have any shape; it may have a shape such as a straight line, a curved line, a zigzag line or the like. For example, the split 104 may have a meander shape. The wording of the meander shape includes concept which is specified by the wordings such as a zigzag shape, a comb tooth shape, and a shape based on an interdigital structure. For example, a meander shape is formed of a combination of a straight line, a curved line, a zigzag line, etc.

For example, the ring-inside conductive portion 102 may be formed of a metal plate. For example, the ring-inside conductive portion 102 may be provided at the same layer where the split-ring conductive portion 101 is provided. A part of the split-ring conductive portion 101 other than another part of the split-ring conductive portion 101, which extends parallel to the ring-inside conductive portion 102, may be provided at a layer different from a layer where the ring-inside conductive portion 102 is provided. For example, the ring-inside conductive portion 102 and the split-ring conductive portion 101 may be formed by cutting out them from one conductive board by a laser, etc.

Figure 13:
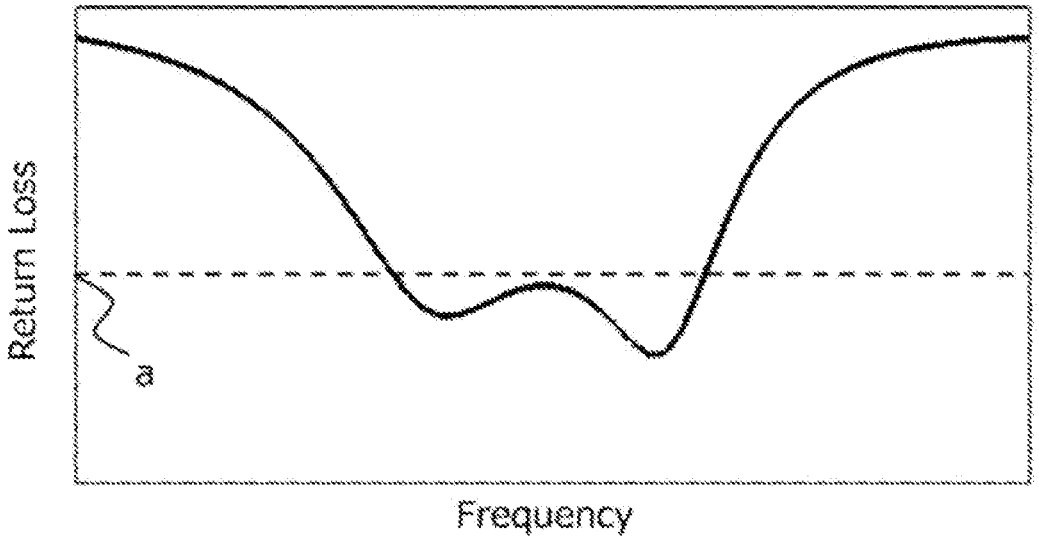
FIG. 13 is a view of an example of characteristics of an antenna according to an aspect of the present disclosure.
Figure 14:
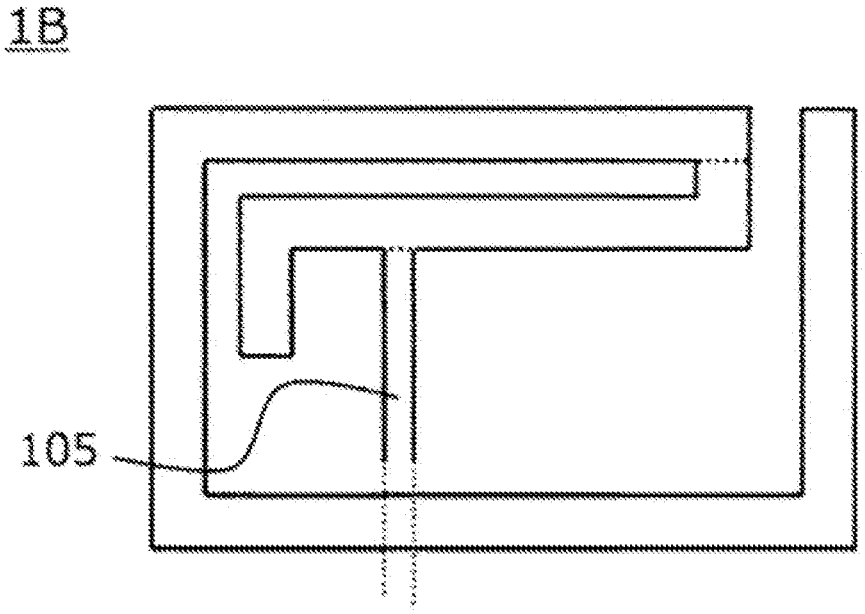
FIG. 14 is a view of an example of an antenna according to an aspect of the present disclosure.
Figure 15:
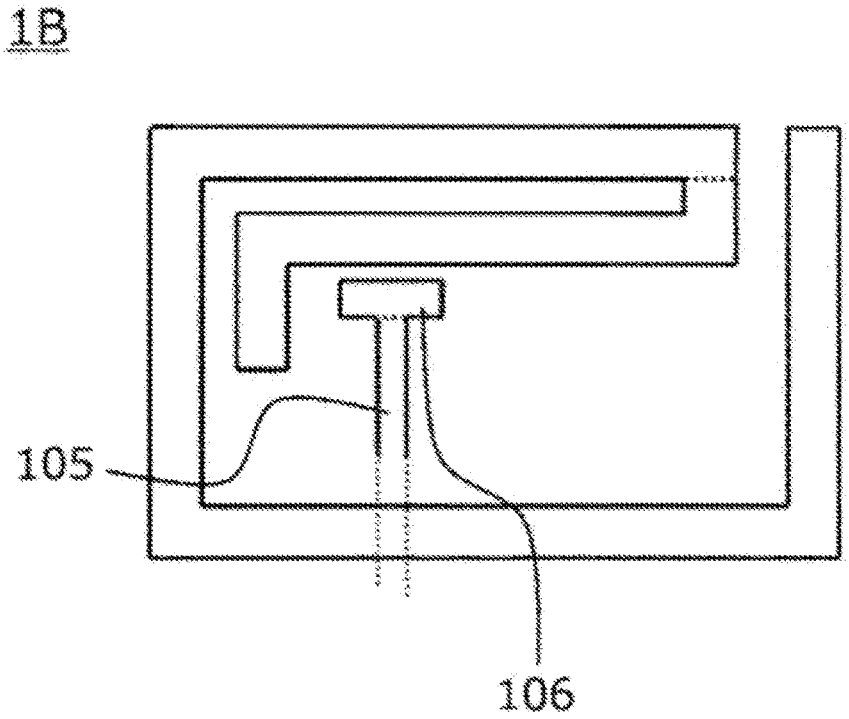
FIG. 15 is a view of an example of an antenna according to an aspect of the present disclosure.
Figure 16:
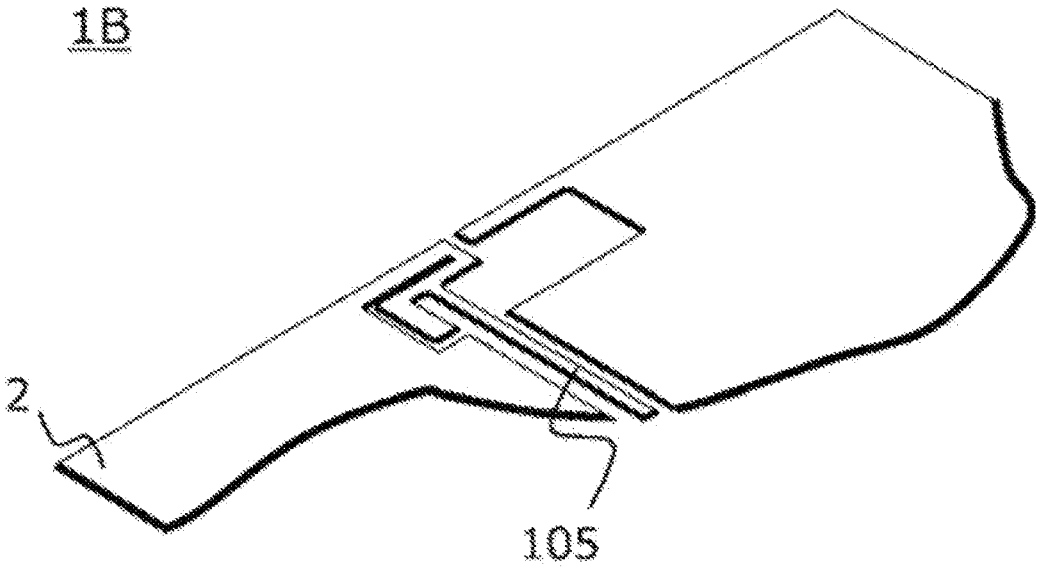
FIG. 16 is a view of an example of an antenna according to an aspect of the present disclosure.
Figure 17:
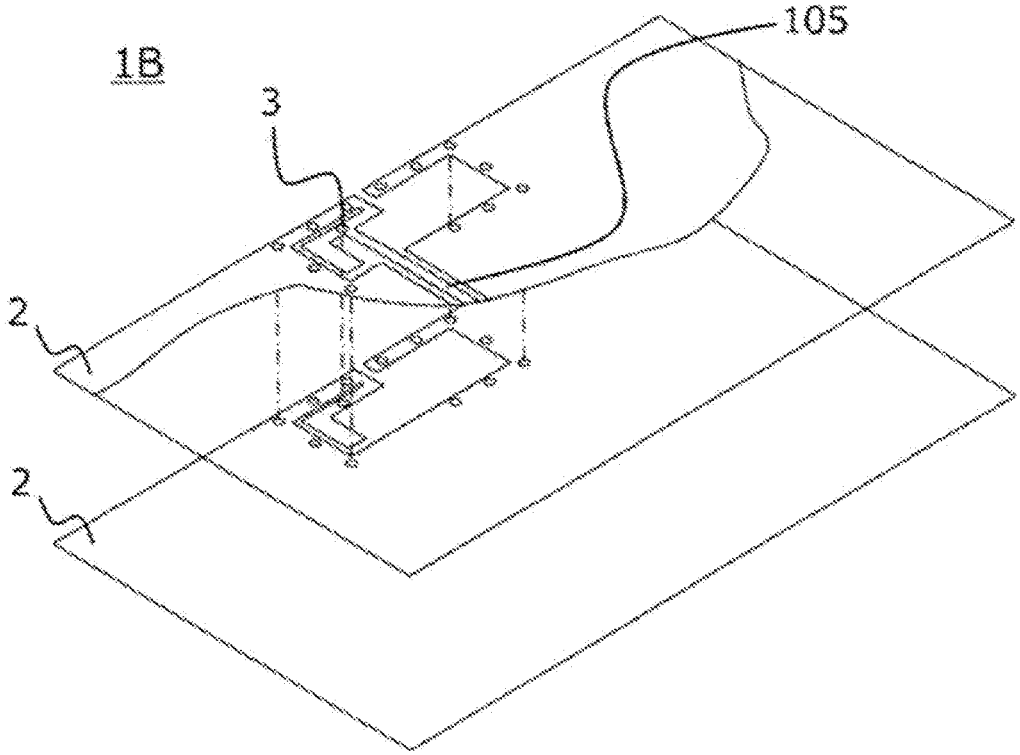
FIG. 17 is a view of an example of an antenna according to an aspect of the present disclosure.
Figure 18:
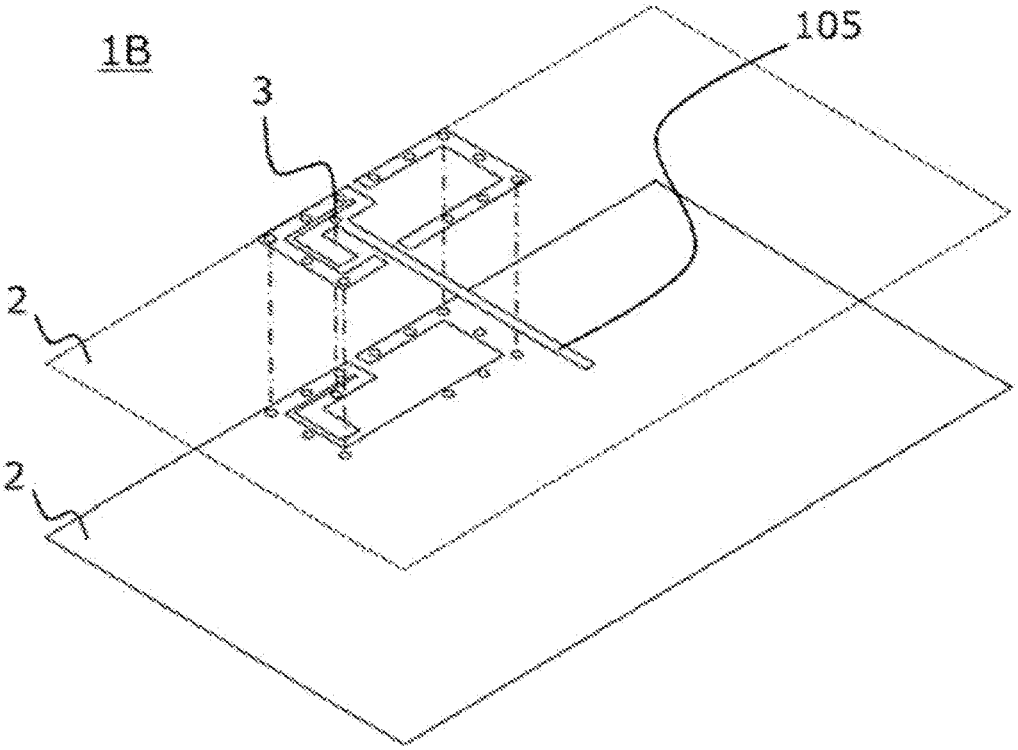
FIG. 18 is a view of an example of an antenna according to an aspect of the present disclosure.
Figure 19:
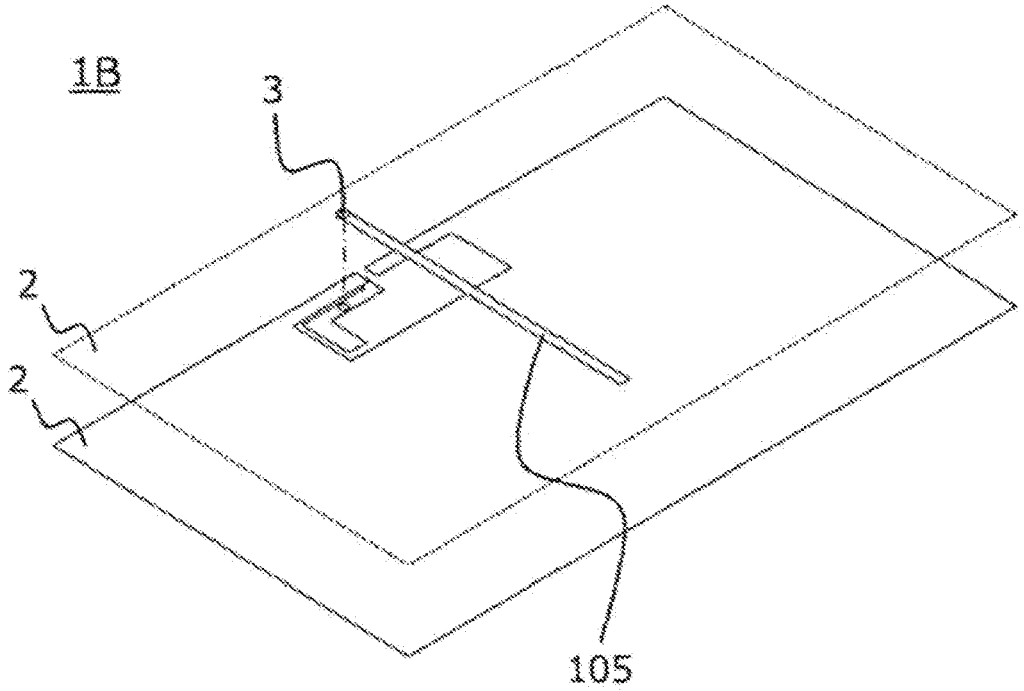
FIG. 19 is a view of an example of an antenna according to an aspect of the present disclosure.
Figure 20:
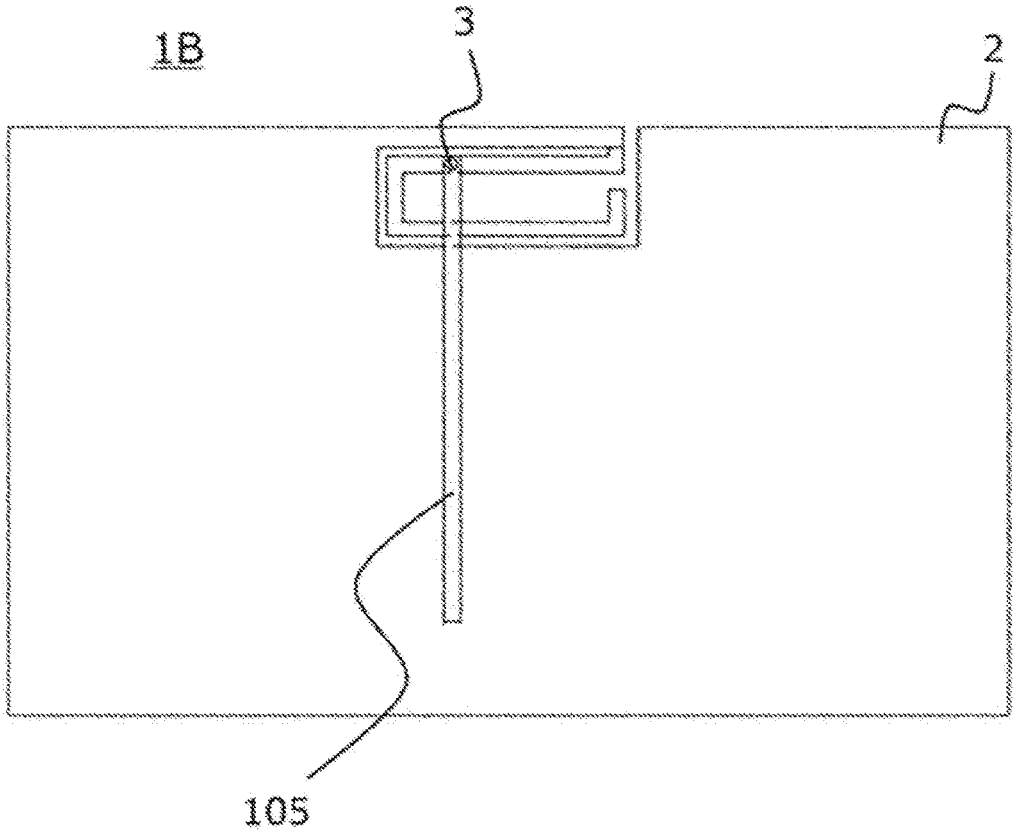
FIG. 20 is a view of an example of an antenna according to an aspect of the present disclosure.
Figure 21:
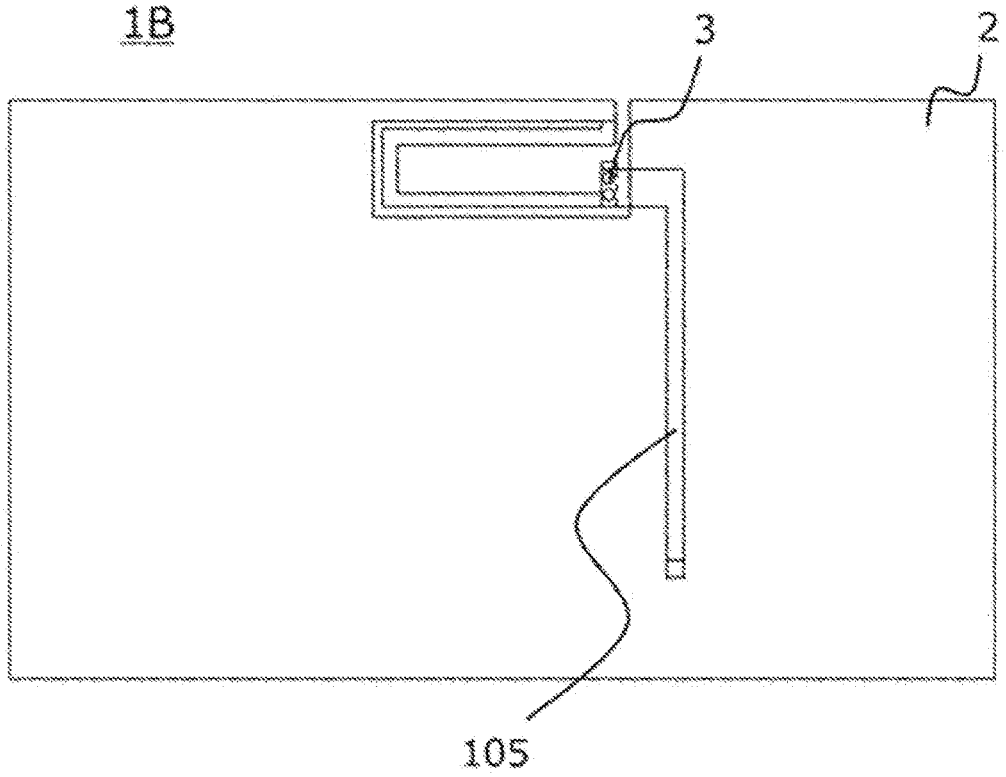
FIG. 21 is a view of an example of an antenna according to an aspect of the present disclosure.
Figure 22:
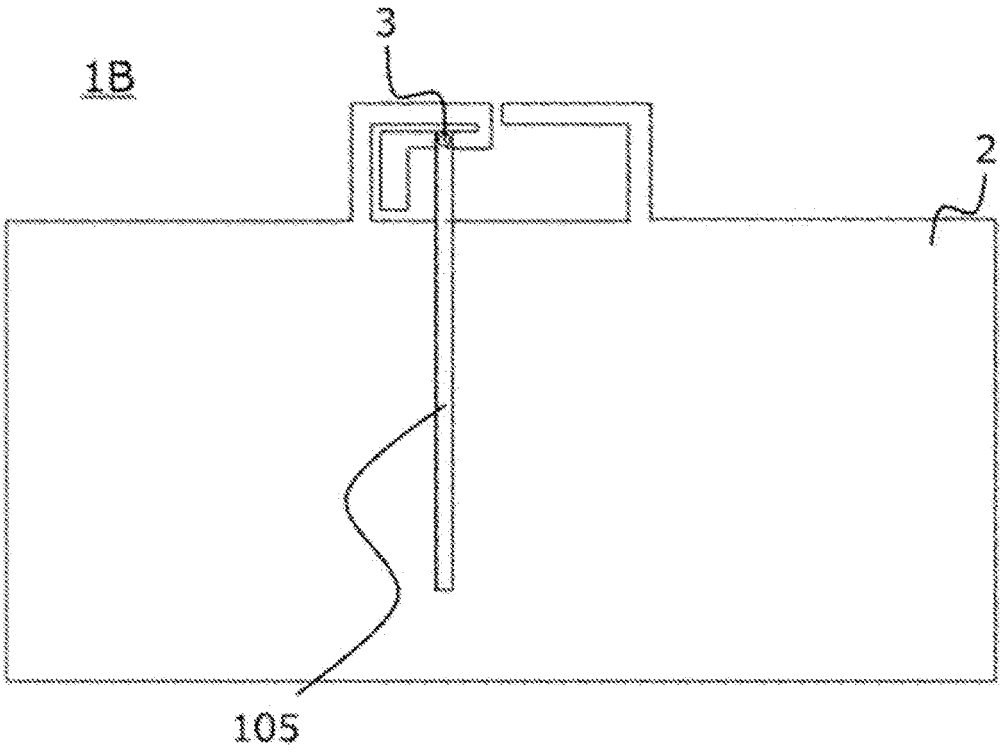
FIG. 22 is a view of an example of an antenna according to an aspect of the present disclosure.
Figure 23:
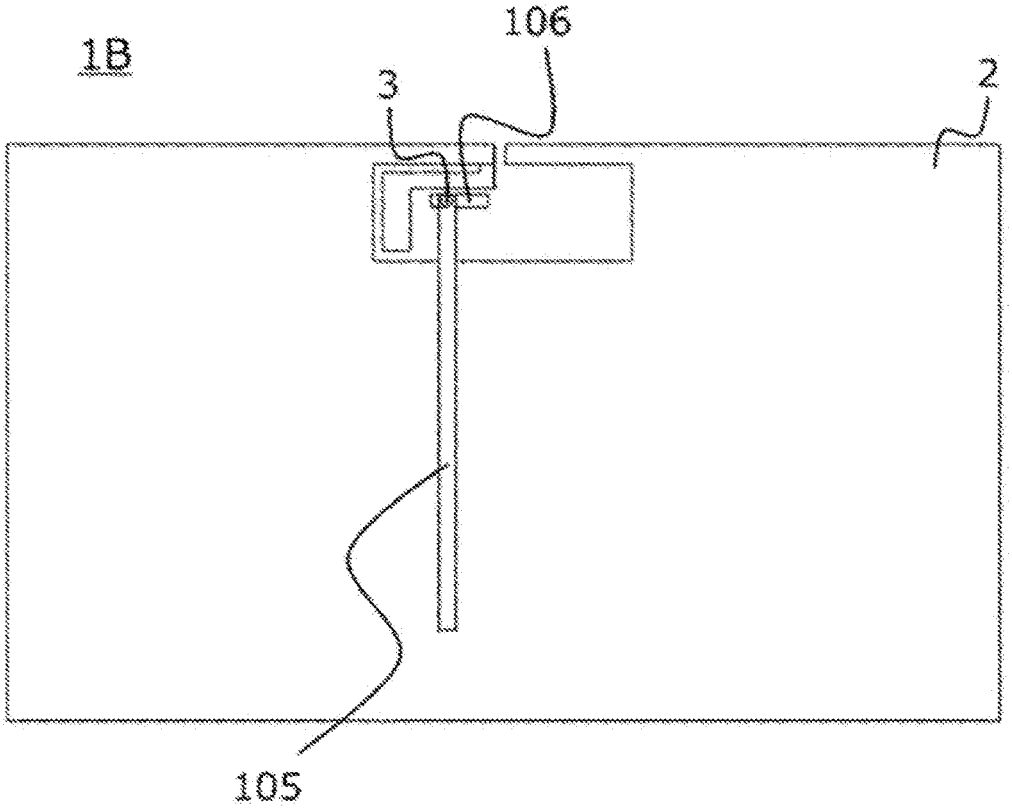
FIG. 23 is a view of an example of an antenna according to an aspect of the present disclosure.
Figure 24:
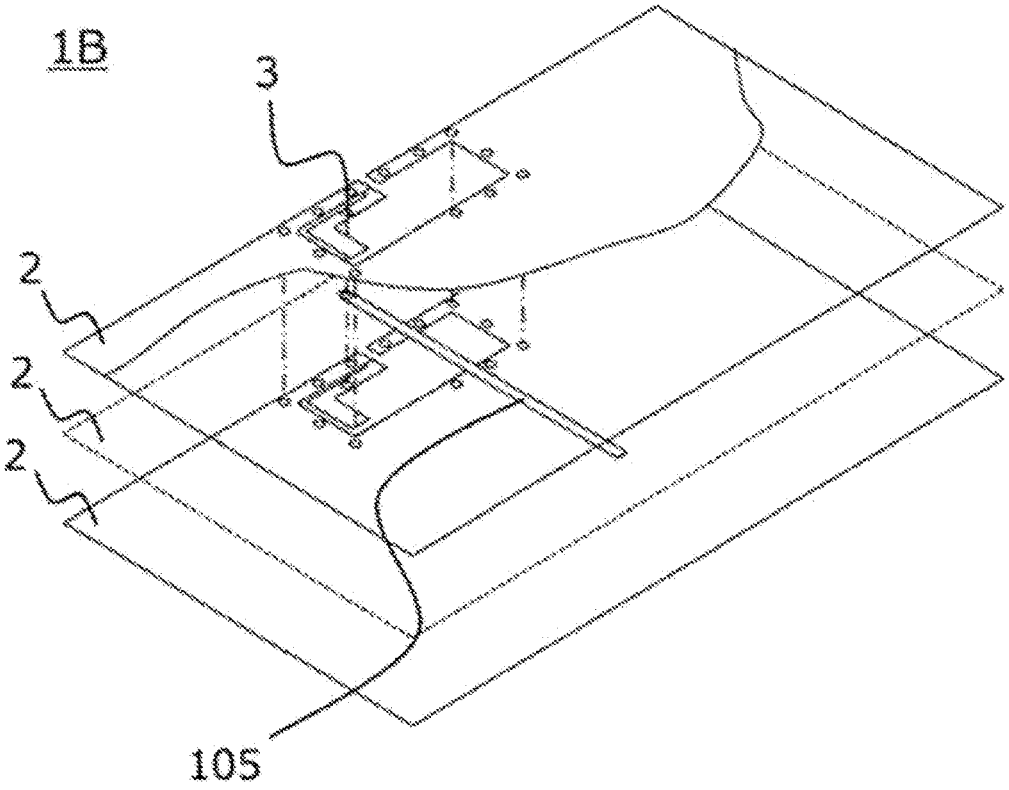
FIG. 24 is a view of an example of an antenna according to an aspect of the present disclosure.
Figure 25:
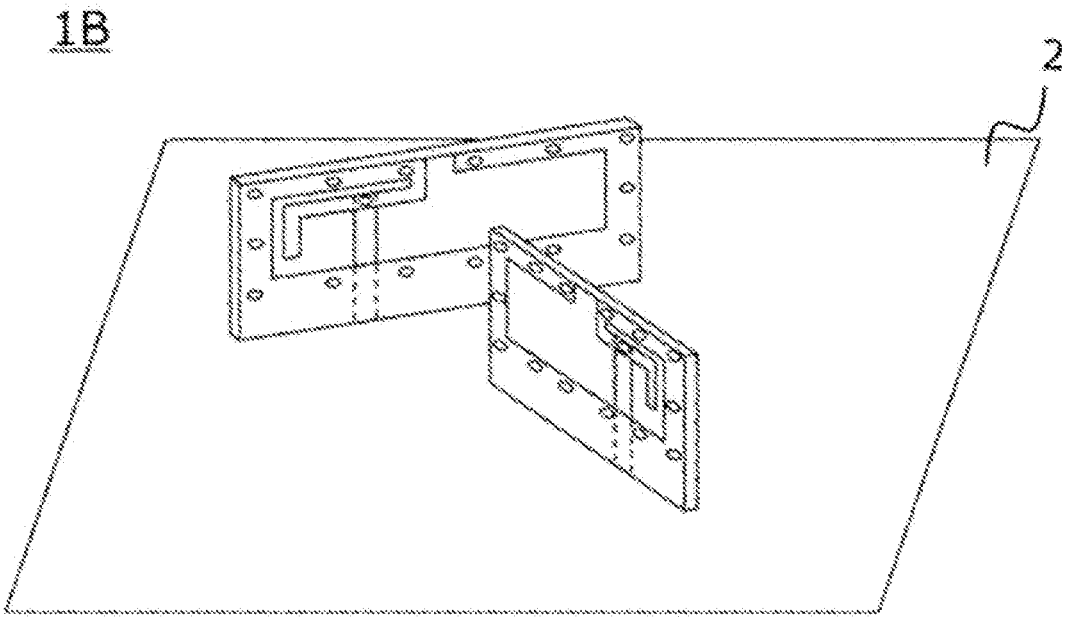
FIG. 25 is a view of an example of an antenna according to an aspect of the present disclosure.
Figure 26:
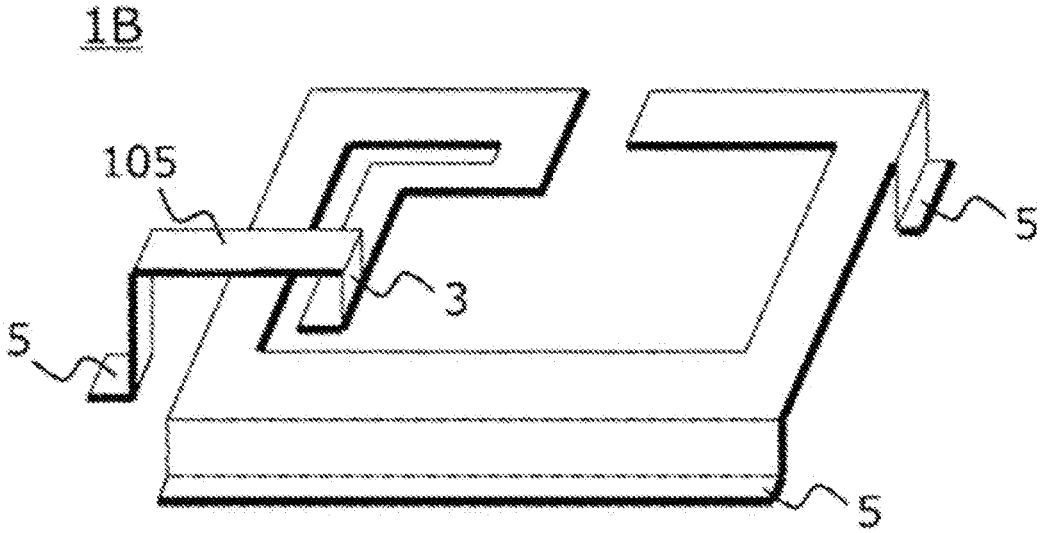
FIG. 26 is a view of an example of an antenna according to an aspect of the present disclosure.
Figure 27:
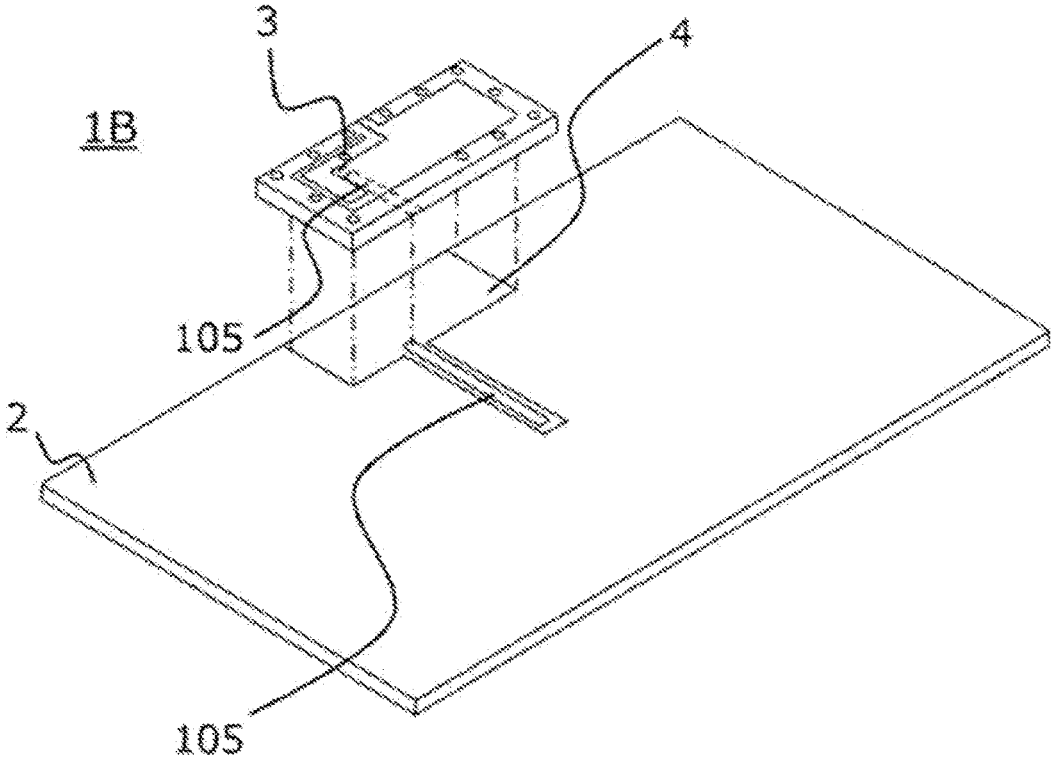
FIG. 27 is a view of an example of an antenna according to an aspect of the present disclosure.

For example, an antenna according to an aspect of the present disclosure can be recognized to comprise two resonant circuits. A first resonant circuit can be recognized to be composed of a capacitance, which is introduced in the split 104 by feeding RF (Radio Frequency) signal to the antenna, and an inductance introduced in the split-ring conductive portion 101 by feeding RF (Radio Frequency) signals to the antenna. The first resonant circuit can be recognized to produce a first resonant frequency. A second resonant circuit can be recognized to be composed of a capacitance, an inductance, another capacitance and another inductance, wherein: the capacitance is introduced in the split 104 by feeding RF signals to the antenna; the inductance is introduced in the ring-inside conductive portion 102 by feeding RF signals to the antenna; the another capacitance is introduced, by feeding RF signals to the antenna, between the split-ring conductive portion 101 and the part of the ring-inside conductive portion 102 extending parallel to the split-ring conductive portion 101; and the another inductance is introduced, by feeding RF signals to the antenna, in the part of the split-ring conductive portion 101 other than the another part of the split-ring conductive portion 101 extending parallel to the ring-inside conductive portion 102. The second resonant circuit can be recognized to produce a second resonant frequency. As understood from above, the resonant frequency of the first resonant circuit and the resonant frequency of the second resonant circuit can be recognized to be different from each other. If the resonant frequency of the first resonant circuit and the resonant frequency of the second circuit are configured to be away from each other, the antenna can resonate at a plurality of resonant frequencies. If the resonant frequency of the first resonant circuit and the resonant frequency of the second circuit are configured to be close to each other, the antenna can have a broadband frequency response. If, for example, the resonant frequency of the second resonant circuit is higher than the resonant frequency of the first resonant circuit, the resonant frequency of the first resonant circuit and the resonant frequency of the second circuit can be adjusted to be close to each other by reducing the resonant frequency of the second resonant circuit. The resonant frequency of the second resonant circuit can be reduced, for example, in any of the following manners: a length of the ring-inside conductive portion 102 is enlarged; a distance between the split-ring conductive portion 101 and the part of the ring-inside conductive portion 102 extending parallel to the split-ring conductive portion 101 is reduced; a chip capacitor is arranged between the split-ring conductive portion 101 and the part of the ring-inside conductive portion 102 extending parallel to the split-ring conductive portion 101; and a region between the split-ring conductive portion 101 and the part of the ring-inside conductive portion 102 extending parallel to the split-ring conductive portion 101 is formed in a meander shape. Thus, an aspect of the present disclosure can provide an antenna, which, while having advantages (small size and low manufacturing cost) of its split-ring resonator, resonates at a plurality of resonant frequencies or has a broadband frequency response. For example, as shown in FIG. 13, an antenna according to an aspect of the present disclosure might have a wider frequency range, where a return loss of the antenna is equal to or less than a threshold "a", in comparison with an assumption where an antenna have a single resonant frequency. Although the threshold "a" is, for example, −10 dB, the present invention is not limited thereto and the antenna should be sufficiently operational under a state where the return loss of the antenna is equal to or less than the threshold "a"

An antenna according to an aspect of the present disclosure may be formed as, for example, a component which is configured to be mounted on a substrate 2 or the like. An antenna according to an aspect of the present disclosure may be, for example, directly formed on the substrate 2. An antenna according to an aspect of the present disclosure may, for example, protrude from the substrate 2. An antenna according to an aspect of the present disclosure may be, for example, arranged substantially perpendicular to the substrate 2.

As shown in FIGS. 1 to 12, an antenna according to an aspect of the present disclosure may be, for example, configured so that a distance between the split-ring conductive portion 101 and the part of the ring-inside conductive portion 102 extending parallel to the split-ring conductive portion 101 is smaller than a distance between the split-ring conductive portion 101 and another part of the ring-inside conductive portion 102 other than the part of the ring-inside conductive portion 102 extending parallel to the split-ring conductive portion 101. An antenna according to an aspect of the present disclosure may be, for example, configured so that the split-ring conductive portion 101 and the part of the ring-inside conductive portion 102 extending parallel to the split-ring conductive portion 101 may be closely positioned to each other enough to have a capacitance which contributes to a resonance of the antenna.

As understood from above, in an aspect of the present disclosure, the second resonant circuit can be recognized to be formed by the another capacitance which is introduced, by feeding RF signals to the antenna, between the split-ring conductive portion 101 and the part of the ring-inside conductive portion 102 extending parallel to the split-ring conductive portion 101.

As shown in FIGS. 14 to 27, an antenna according to an aspect of the present disclosure, which is for example the antenna 1A or their modifications, may be, for example, configured so that electrical power is supplied to the ring-inside conductive portion 102 by using connection of a feed line 105 with the ring-inside conductive portion 102 or is wirelessly supplied to the ring-inside conductive portion 102.

The feed line 105 may be, for example, connected with any part of the ring-inside conductive portion 102, and impedances of an RF circuit and an antenna according to an aspect of the present disclosure can be matched to each other by adjusting a junction of the ring-inside conductive portion 102 with the feed line 105. For example, the feed line 105 may be configured so that the feed line 105 is provided at a layer different from the layer, where the ring-inside conductive portion 102 is provided, while the feed line 105 is connected with the ring-inside conductive portion 102 through a via 3. For example, the feed line 105 may be provided at the same layer where the ring-inside conductive portion 102 is provided, the feed line 105 may extend in the region 103, and the feed line 105 may extend along the split-ring conductive portion 101 or along a clearance provided on the substrate. For example, the feed line 105 may be formed of a wire such as a transmission line or the like, or may be formed of a metal plate. For example, the ring-inside conductive portion 102 and the metal plate part of the feed line 105 may be formed by cutting out them from one conductive board by a laser, etc.

Wireless electrical power supply to the ring-inside conductive portion 102 may be done by, for example, using an EM (Electro-magnetic) coupling portion 106 with which the feed line 105 is connected. The EM coupling portion 106 may be, for example, electromagnetically connected with any part of the ring-inside conductive portion 102, and impedances of an RF circuit and an antenna according to an aspect of the present disclosure can be matched to each other by adjusting a part of the ring-inside conductive portion 102 which is electromagnetically connected with the EM coupling portion 106. For example, the EM coupling portion 106 may be provided at a layer different from the layer where the ring-inside conductive portion 102 is provided. For example, the EM coupling portion 106 may be provided at the same layer where the ring-inside conductive portion 102 is provided, the feed line 105 connected with the EM coupling portion 106 may extend in the region 103, and the feed line 105 connected with the EM coupling portion 106 may extend along the split-ring conductive portion 101 or along the clearance provided on the substrate. For example, the EM coupling portion 106 may be formed of a metal plate. For example, the ring-inside conductive portion 102 and the EM coupling portion 106 may be formed by cutting out them from one conductive board by a laser, etc. For example, the EM coupling portion 106 and the metal plate part of the feed line 105 may be formed by cutting out them from one conductive board by a laser, etc.

As described above, according to an aspect of the present disclosure, for example, electrical power is directly supplied to the second resonant circuit while electrical power is supplied to the first resonant circuit through the ring-inside conductive portion 102. Thus, an antenna according to an aspect of the present disclosure has an excellent antenna characteristics in comparison with an assumption where electrical power is supplied not to the ring-inside conductive portion 102 but to the split-ring conductive portion 101 by using connection of a feed line or is wirelessly supplied thereto.

Figure 28:
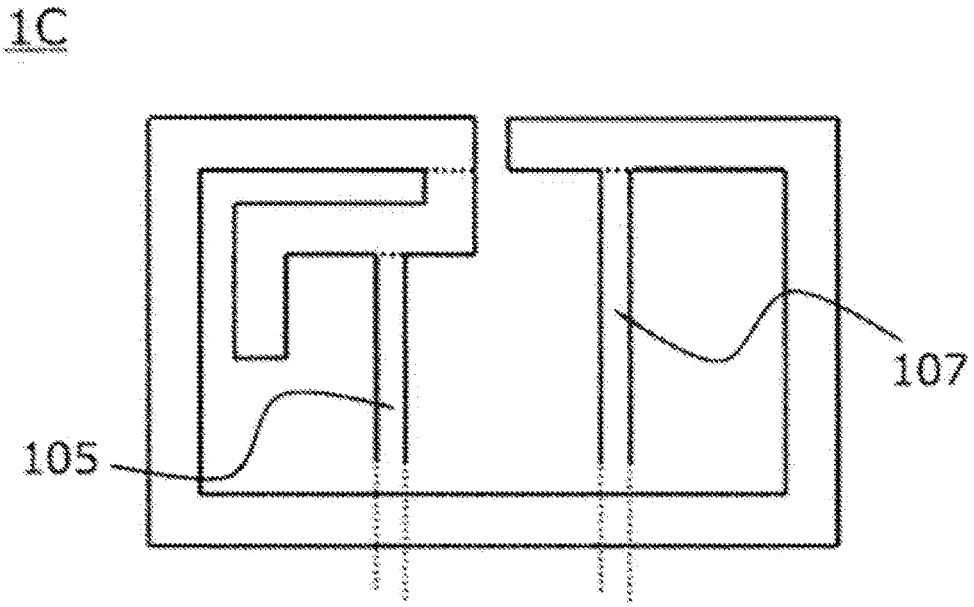
FIG. 28 is a view of an example of an antenna according to an aspect of the present disclosure.
Figure 29:
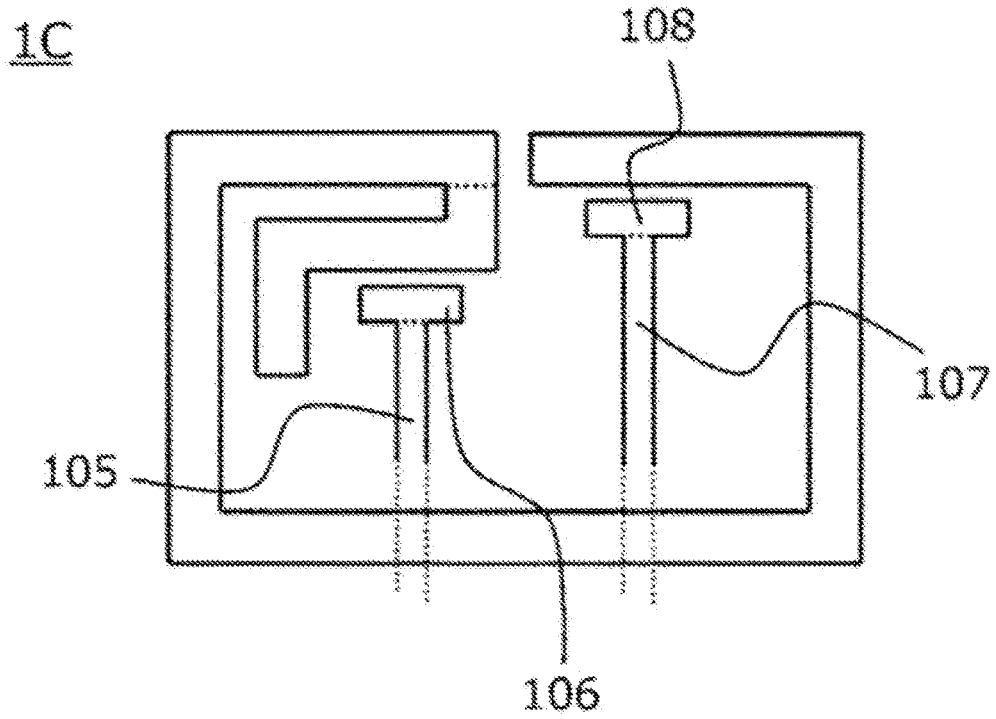
FIG. 29 is a view of an example of an antenna according to an aspect of the present disclosure.

As shown in FIGS. 28 and 29, an antenna according to an aspect of the present disclosure, which is for example the antenna 1B or their modifications, may be, for example, configured so that electrical power is supplied to the split-ring conductive portion 101 by using connection of a feed line 107 with the split-ring conductive portion 101 or is wirelessly supplied thereto.

The feed line 107 may be, for example, connected with any part of the split-ring conductive portion 101, and impedances of an RF circuit and an antenna according to an aspect of the present disclosure can be matched to each other by adjusting a junction of the split-ring conductive portion 101 with the feed line 107. For example, the feed line 107 may be configured so that the feed line 107 is provided at a layer different from the layer, where the split-ring conductive portion 101 is provided, while the feed line 107 is connected with the split-ring conductive portion 101 through the via 3. For example, the feed line 107 may be provided at the same layer where the split-ring conductive portion 101 is provided, the feed line 107 may extend in the region 103, and the feed line 107 may extend along the split-ring conductive portion 101 or along the clearance provided on the substrate. For example, the feed line 107 may be formed of a wire such as a transmission line or the like, or may be formed of a metal plate. For example, the split-ring conductive portion 101 and the metal plate part of the feed line 107 may be formed by cutting out them from one conductive board by a laser, etc.

Wireless electrical power supply to the split-ring conductive portion 101 may be done by, for example, using an EM (Electro-magnetic) coupling portion 108 with which the feed line 107 is connected. The EM coupling portion 108 may be, for example, electromagnetically connected with any part of the split-ring conductive portion 101, and impedances of an RF circuit and an antenna according to an aspect of the present disclosure can be matched to each other by adjusting a part of the split-ring conductive portion 101 which is electromagnetically connected with the EM coupling portion 108. For example, the EM coupling portion 108 may be provided at a layer different from the layer where the split-ring conductive portion 101 is provided. For example, the EM coupling portion 108 may be provided at the same layer where the split-ring conductive portion 101 is provided, the feed line 107 connected with the EM coupling portion 108 may extend in the region 103, and the feed line 107 may extend along the split-ring conductive portion 101 or along the clearance provided on the substrate. For example, the EM coupling portion 108 may be formed of a metal plate. For example, the split-ring conductive portion 101 and the EM coupling portion 108 may be formed by cutting out them from one conductive board by a laser, etc. For example, the EM coupling portion 108 and the metal plate part of the feed line 107 may be formed by cutting out them from one conductive board by a laser, etc.

As described above, an antenna according to an aspect of the present disclosure is, for example, configured so that electrical power is directly supplied also to the first resonant circuit. Thus, an antenna according to an aspect of the present disclosure, for example, allows for finer tuning.

Figure 30:
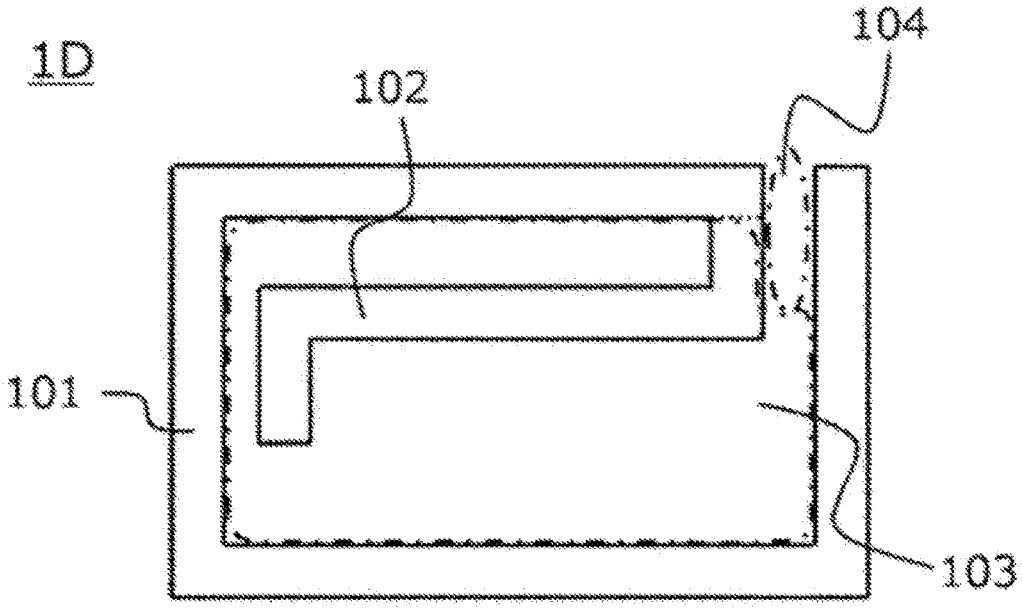
FIG. 30 is a view of an example of an antenna according to an aspect of the present disclosure.
Figure 31:
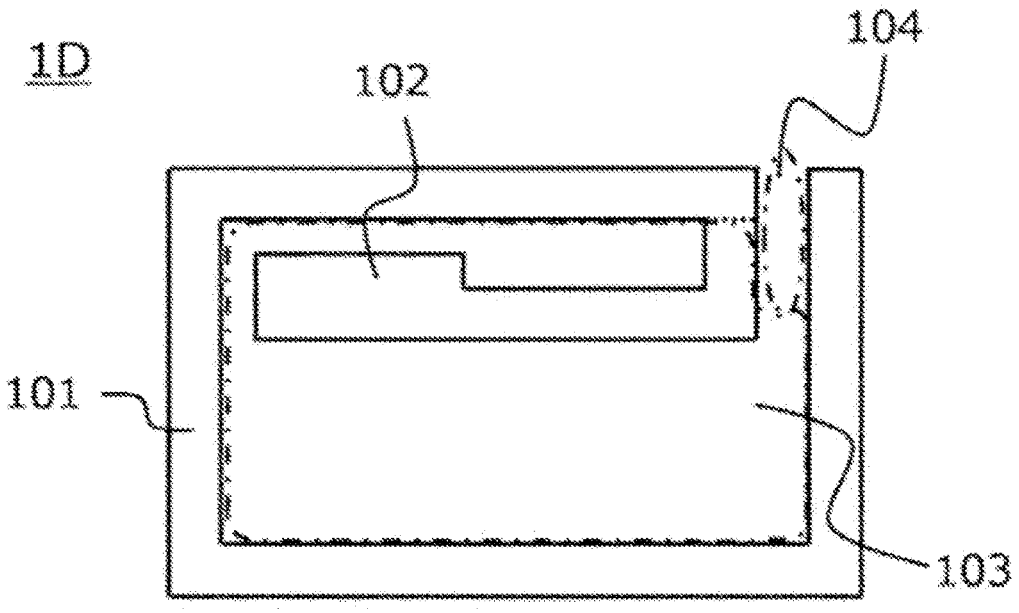
FIG. 31 is a view of an example of an antenna according to an aspect of the present disclosure.

As shown in FIGS. 30 and 31, an antenna according to an aspect of the present disclosure, which is for example the antennas 1A, 1B, 1C or their modifications, may be, for example, configured as follows: the region 103 may have a substantially rectangular shape; the split 104 may be positioned around a corner, or a vertex, of the region 103; and the ring-inside conductive portion 102 may be configured so that a part of the ring-inside conductive portion 102 between a distal end of the ring-inside conductive portion 102 and a first bent of the ring-inside conductive portion 102, which counts from a junction of the ring-inside conductive portion 102 with the split-ring conductive portion 101, is bent once so as to extend parallel to the split-ring conductive portion 101. As shown in FIGS. 30 and 31, in an antenna according to an aspect of the present disclosure, which is for example the antennas 1A, 1B, 1C or their modifications, a distance between the split-ring conductive portion 101 and a part of the ring-inside conductive portion 102 between the distal end and a second bent of the ring-inside conductive portion 102, which counts from the junction with the split-ring conductive portion 101, may be smaller than a distance between the split-ring conductive portion 101 and another part of the ring-inside conductive portion 102 between two of the bents.

An antenna according to an aspect of the present disclosure as described above can provide, for example, good response, in particular, over a wide frequency range.

Figure 32:
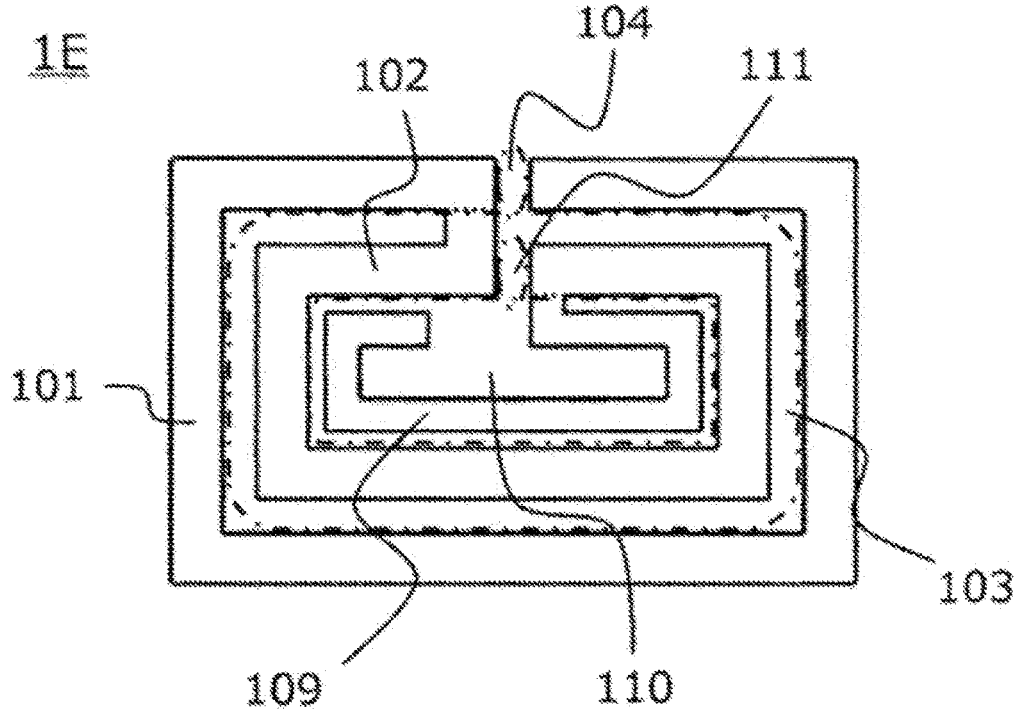
FIG. 32 is a view of an example of an antenna according to an aspect of the present disclosure.
Figure 33:
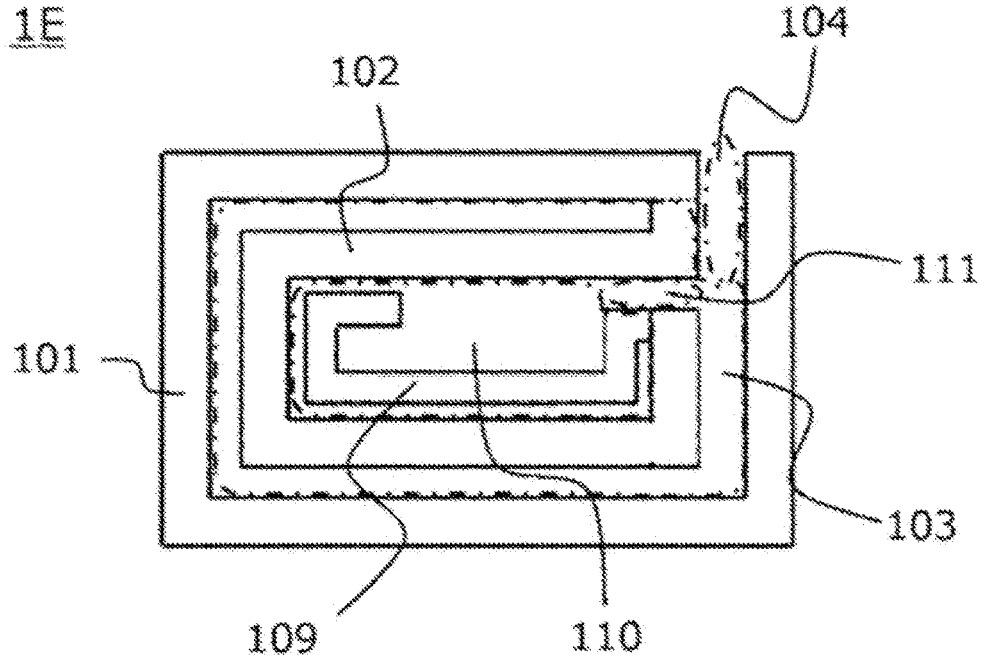
FIG. 33 is a view of an example of an antenna according to an aspect of the present disclosure.
Figure 34:
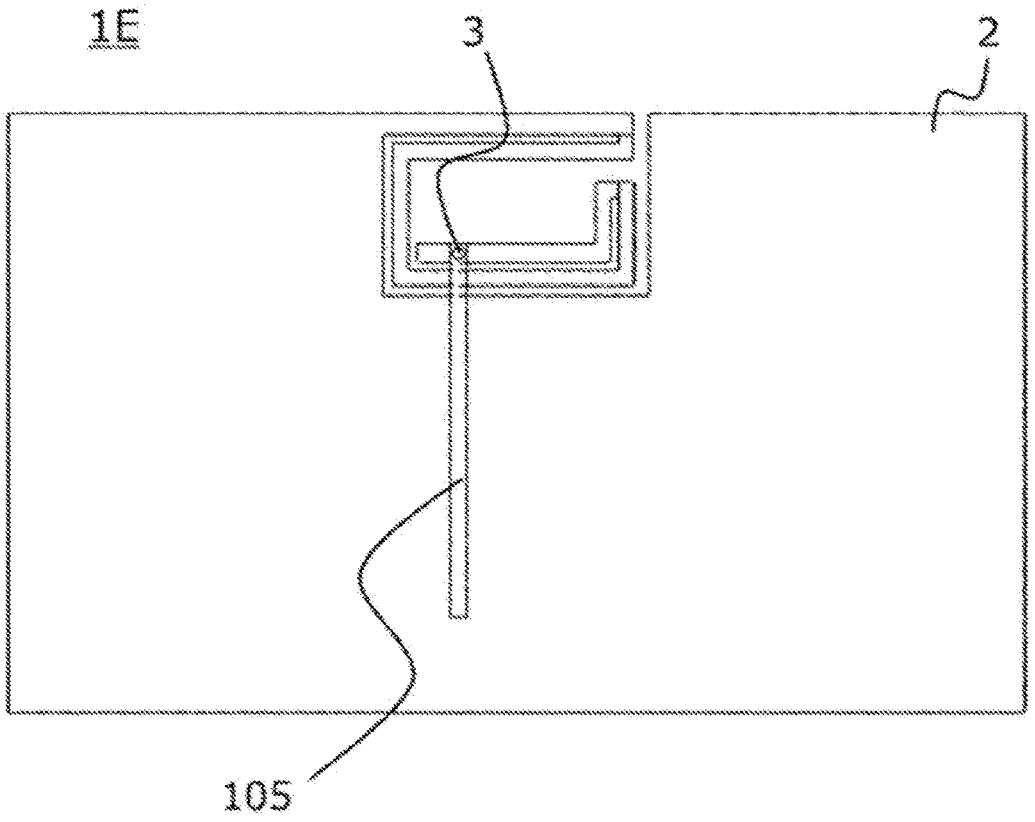
FIG. 34 is a view of an example of an antenna according to an aspect of the present disclosure.

As shown in FIGS. 32 to 34, an antenna according to an aspect of the present disclosure, which is for example the antennas 1A, 1B, 10, 1D or their modifications, may further comprise, for example, a ring-inside conductive portion 109, wherein: the ring-inside conductive portion 102 may be positioned outside a region 110 and may be positioned in an area which extends along an outline of the region 110 except for a split 111; the ring-inside conductive portion 109 may be positioned inside the region 110; the ring-inside conductive portion 109 may be continuous with one of parts of the ring-inside conductive portion 102, the split 111 being put between the parts of the ring-inside conductive portion 102; and at least a part of the ring-inside conductive portion 109 may be bent so as to extend parallel to the ring-inside conductive portion 102.

For example, the region 110 may be surrounded by the ring-inside conductive portion 102 and the split 111. For example, the region 110 may have any shape; it may have a polygonal shape such as a square, a rectangle or the like, or a shape such as a circle, an oval or the like.

For example, the split 111 may be filled with nothing, and may be filled with resin or the like. For example, the split 111 may have any shape; it may have a shape such as a straight line, a curved line, a zigzag line or the like. For example, the split 111 may have a meander shape.

For example, the ring-inside conductive portion 109 may be formed of a metal plate. For example, the ring-inside conductive portion 109 may be provided at the same layer where the ring-inside conductive portion 102 is provided. A part of the ring-inside conductive portion 102 other than another part of the ring-inside conductive portion 102, which extends parallel to the ring-inside conductive portion 109, may be provided at a layer different from the layer where the ring-inside conductive portion 109 is provided. For example, the ring-inside conductive portion 109 and the ring-inside conductive portion 102 may be formed by cutting out them from one conductive board by a laser, etc. For example, electrical power may be supplied to the ring-inside conductive portion 109 by using connection of a feed line with the ring-inside conductive portion 109 or may be wirelessly supplied to the ring-inside conductive portion 109.

An antenna according to an aspect of the present disclosure as describe above can be recognized to further comprise a third resonant circuit. For example, the third resonant circuit can be recognized to be composed of a capacitance, an inductance, another capacitance and another inductance, wherein: the capacitance is introduced in the split 111 by feeding RF signals to the antenna; the inductance is introduced in the ring-inside conductive portion 109 by feeding RF signals to the antenna; the another capacitance is introduced, by feeding RF signals to the antenna, between the ring-inside conductive portion 102 and a part of the ring-inside conductive portion 109 extending parallel to the ring-inside conductive portion 102; and the another inductance is introduced, by feeding RF signals to the antenna, in the part of the ring-inside conductive portion 102 other than the another part of the ring-inside conductive portion 102 extending parallel to the ring-inside conductive portion 109. Thus, an aspect of the present disclosure can provide an antenna, which, while having an advantage (small size and low manufacturing cost) of its split-ring resonator, resonates at a plurality of resonant frequencies or has a broadband frequency response.

According to an aspect of the present disclosure, for example, ring-inside conductive portions are analogously formed in the region 103, the region 110, a region 112, etc., and thereby an aspect of the present disclosure can provide an antenna, which, while having an advantage (small size and low manufacturing cost) of its split-ring resonator, resonates at a plurality of resonant frequencies or has a broadband frequency response.

A communication device according to an aspect of the present disclosure may, for example, comprise an antenna according to an aspect of the present disclosure, which is for example the antennas 1A, 1B, 10, 1D, 1E or their modifications.

An aspect of the present disclosure as described above can provide a communication device which has a reduced size and provides good performance.

The present invention has been described above in connection with the above-mentioned embodiments which are exemplary examples of antennas. However, the present invention is not limited to the embodiments as described above. Within the scope of the present invention, the present invention can provide for various embodiments that can be understood by a person skilled in the art.

The present application is based on a Japanese patent application of JP2018-170131 filed before the Japan Patent Office on Sep. 12, 2018, the content of which is incorporated herein by reference.

REFERENCE SIGNS LIST

1A, 1B, 10, 1D, 1E: antenna
101: split-ring conductive portion
1011: auxiliary conductive portion
102: ring-inside conductive portion
103: region
104: split
105: feed line
106: EM coupling portion
107: feed line
108: EM coupling portion
109: ring-inside conductive portion
110: region
111: split
112: region
2: substrate
3: via
4: land pattern
5: grounding portion
a: threshold

The invention claimed is:

1. An antenna comprising a split-ring conductive portion and a ring-inside conductive portion, wherein:

the split-ring conductive portion is positioned outside a region and is positioned in an area which extends along an outline of the region except for a split;

the ring-inside conductive portion is positioned inside the region;

the ring-inside conductive portion is continuous with one of parts of the split-ring conductive portion, the split being provided between the parts of the split-ring conductive portion;

at least a part of the ring-inside conductive portion is bent so as to extend parallel to the split-ring conductive portion;

the antenna comprises a split-ring resonator;

the antenna further comprises a feed line directly connected to the ring-inside conductive portion;

the feed line is configured to supply electrical power to the ring-inside conductive portion;

the feed line extends in a direction away from the split; and the feed line reaches an area outside of the region.

2. The antenna as recited in claim 1, wherein the split-ring conductive portion and the part of the ring-inside conductive portion extending parallel to the split-ring conductive portion are positioned close enough to each other to have a capacitance which contributes to a resonance of the antenna.

3. The antenna as recited in claim 1, wherein electrical power is supplied to the split-ring conductive portion by connection of a second feed line with the split-ring conductive portion or is wirelessly supplied to the split-ring conductive portion.

4. The antenna as recited in claim 1, wherein:

the region has a rectangular shape;

the split is positioned adjacent to a corner of the region; and the ring-inside conductive portion is configured so that a part of the ring-inside conductive portion between a distal end of the ring-inside conductive portion and a first bend of the ring-inside conductive portion, counting from a junction of the ring-inside conductive portion with the split-ring conductive portion, is bent once so as to extend parallel to the split-ring conductive portion.

5. The antenna as recited in claim 4, wherein a distance between the split-ring conductive portion and a part of the ring-inside conductive portion between the distal end thereof and a second bend counting from the junction with the split-ring conductive portion is smaller than a distance between the split-ring conductive portion and another part of the ring-inside conductive portion between the two bends.

6. The antenna as recited in claim 1, wherein:

the antenna further comprises a second ring-inside conductive portion;

the ring-inside conductive portion is positioned outside a second region and is positioned in an area which extends along an outline of the second region except for a second split;

the second ring-inside conductive portion is positioned inside the second region;

the second ring-inside conductive portion is continuous with one of parts of the ring-inside conductive portion, the second split being provided between the parts of the ring-inside conductive portion; and at least a part of the second ring-inside conductive portion is bent so as to extend parallel to the ring-inside conductive portion.

7. A communication device comprising the antenna as recited in claim 1.

* * * * *